US009154875B2

(12) United States Patent
Van Reck

(10) Patent No.: US 9,154,875 B2
(45) Date of Patent: Oct. 6, 2015

(54) DEVICE FOR AND METHOD OF PROCESSING AN AUDIO DATA STREAM

(75) Inventor: Kristof Van Reck, Niel (BE)

(73) Assignee: NXP B.V., Eindhoven (NL)

( * ) Notice: Subject to any disclaimer, the term of this patent is extended or adjusted under 35 U.S.C. 154(b) by 1564 days.

(21) Appl. No.: 12/097,110

(22) PCT Filed: Dec. 7, 2006

(86) PCT No.: PCT/IB2006/054659

§ 371 (c)(1),
(2), (4) Date: Mar. 6, 2009

(87) PCT Pub. No.: WO2007/069150

PCT Pub. Date: Jun. 21, 2007

(65) Prior Publication Data

US 2009/0216353 A1 Aug. 27, 2009

(30) Foreign Application Priority Data

Dec. 13, 2005 (EP) ..... 05112028

(51) Int. Cl.
*G06F 17/00* (2006.01)
*H04R 3/04* (2006.01)
*H04R 5/04* (2006.01)

(52) U.S. Cl.
CPC .. *H04R 3/04* (2013.01); *H04R 5/04* (2013.01); *H04R 2420/07* (2013.01); *H04R 2499/11* (2013.01)

(58) Field of Classification Search
CPC ..... H04R 3/04; H04R 5/04; H04R 2420/07; H04R 2499/11
USPC ..... 700/94
See application file for complete search history.

(56) References Cited

U.S. PATENT DOCUMENTS

| | | | | |
|---|---|---|---|---|
| 5,424,488 | A * | 6/1995 | Werrbach | 84/698 |
| 5,886,276 | A * | 3/1999 | Levine et al. | 84/603 |
| 6,049,766 | A * | 4/2000 | Laroche | 704/216 |
| 6,266,644 | B1 * | 7/2001 | Levine | 704/503 |
| 6,535,846 | B1 * | 3/2003 | Shashoua | 704/225 |
| 6,678,380 | B2 | 1/2004 | Aarts | |
| 6,766,300 | B1 * | 7/2004 | Laroche | 704/500 |
| 6,930,373 | B2 * | 8/2005 | Auerswald et al. | 257/579 |

(Continued)

FOREIGN PATENT DOCUMENTS

| | | |
|---|---|---|
| CN | 1249890 A | 4/2000 |
| EP | 0972426 B1 | 1/2000 |

(Continued)

OTHER PUBLICATIONS

Waves C1 documentation: available at archive.org as of Nov. 2005.*

(Continued)

*Primary Examiner* — Paul McCord

(57) ABSTRACT

A device (200) for processing an audio data stream, the device (200) comprising a transient detection unit (201) adapted to detect a transient portion of an audio input data stream (202), and a harmonics generator (203) adapted to generate an audio output data stream (204) based on the audio input data stream (202), the audio output data stream (204) comprising a sequence of harmonics (205) generated only from a non-transient portion of the audio input data stream (202).

19 Claims, 2 Drawing Sheets

(56) References Cited

U.S. PATENT DOCUMENTS

| | | | | |
|---|---|---|---|---|
| 7,391,875 | B2 * | 6/2008 | Shashoua | 381/119 |
| 7,447,639 | B2 * | 11/2008 | Wang | 704/503 |
| 7,709,723 | B2 * | 5/2010 | Pachet et al. | 84/603 |
| 7,876,909 | B2 * | 1/2011 | Neoran et al. | 381/63 |
| 8,019,598 | B2 * | 9/2011 | Sakurai et al. | 704/211 |
| 8,577,482 | B2 * | 11/2013 | Herre et al. | 700/94 |
| 2003/0115052 | A1 * | 6/2003 | Chen et al. | 704/230 |
| 2004/0022400 | A1 * | 2/2004 | Magrath | 381/106 |
| 2004/0114769 | A1 * | 6/2004 | Little | 381/71.11 |
| 2004/0122662 | A1 * | 6/2004 | Crockett | 704/200.1 |
| 2005/0245221 | A1 * | 11/2005 | Beyer | 455/222 |
| 2006/0018486 | A1 * | 1/2006 | Neoran et al. | 381/63 |
| 2006/0031075 | A1 * | 2/2006 | Oh et al. | 704/500 |
| 2006/0139093 | A1 * | 6/2006 | Gagon | 330/126 |
| 2007/0021959 | A1 | 1/2007 | Goto | |
| 2007/0137466 | A1 * | 6/2007 | Lindemann | 84/626 |
| 2008/0002842 | A1 * | 1/2008 | Neusinger et al. | 381/119 |
| 2008/0253440 | A1 * | 10/2008 | Srinivasan et al. | 375/240 |
| 2010/0204995 | A1 * | 8/2010 | Peissig et al. | 704/500 |

FOREIGN PATENT DOCUMENTS

| | | | |
|---|---|---|---|
| EP | 1293961 | A1 | 3/2003 |
| JP | 2005049364 | A | 2/2005 |
| WO | 0015003 | A2 | 3/2000 |

OTHER PUBLICATIONS

Compander shootout article: Sound on Sound; copyright 1999.*
Forat Drum Synthesizer: Available for sale at least Sep. 2005.*
Roads, C., "The Computer Music Tutorial," Japanese Edition, Denki Daigaku Shuppan, Tokyo, Jan. 2001.
Kazuyoshi, Y., "Drum Sound Identification for Polyphonic Music Using Template Adaptation and Matching Methods," SAPA, Oct. 3, 2004.

* cited by examiner

DEVICE FOR AND METHOD OF PROCESSING AN AUDIO DATA STREAM

FIELD OF THE INVENTION

The invention relates to a device for processing an audio data stream.

The invention further relates to a method of processing an audio data stream.

The invention also relates to a program element.

Furthermore, the invention relates to a computer-readable medium.

BACKGROUND OF THE INVENTION

Audio playback devices are becoming more and more important. Particularly, increasing numbers of users buy harddisk-based audio players and other entertainment equipment.

Psycho-acoustic tricks may be used to improve audio playback quality.

EP 0,972,426 discloses an apparatus for conveying a pseudo-low frequency psycho-acoustic sensation of a sound signal to a listener, the apparatus including a frequency unit which is capable of deriving a high-frequency signal and a low-frequency signal from the sound signal within a low-frequency range of interest. A harmonics generator is coupled to the frequency generator and is capable of generating, for each fundamental frequency within the low-frequency range of interest, a residual harmonic signal having a sequence of harmonics. The sequence of harmonics, generated with respect to each fundamental frequency, comprises a first group of harmonics that includes at least three consecutive harmonics from among a primary set of harmonics of the fundamental frequency. A loudness generator is coupled to the harmonics generator and is capable of matching the loudness of the residual harmonic signal with the loudness of the low-frequency signal. A summation unit is capable of summing the residual harmonic signal and the high-frequency signal so as to obtain a psycho-acoustic alternative signal.

However, there are circumstances in which the audio playback quality of the system of EP 0,972,426 is not sufficient.

OBJECT AND SUMMARY OF THE INVENTION

It is an object of the invention to improve the audio playback.

In order to achieve the object defined above, a device for processing an audio data stream, a method of processing an audio data stream, a program element and a computer-readable medium as defined in the independent claims are provided.

In accordance with an embodiment of the invention, a device for processing an audio data stream is provided, the device comprising a transient detection unit adapted to detect a transient portion of an audio input data stream, and a harmonics generator adapted to generate an audio output data stream based on the audio input data stream, the audio output data stream comprising a sequence of harmonics generated only from a non-transient portion of the audio input data stream.

In accordance with another embodiment of the invention, a method of processing an audio data stream is provided, the method comprising the steps of detecting a transient portion of an audio input data stream, and generating an audio output data stream based on the audio input data stream, the audio output data stream comprising a sequence of harmonics generated only from a non-transient portion of the audio input data stream.

In accordance with yet another embodiment of the invention, a program element is provided, which, when being executed by a processor, is adapted to control or carry out a method of processing an audio data stream having the above-mentioned features.

In accordance with a further embodiment of the invention, a computer-readable medium is provided, in which a computer program is stored which, when being executed by a processor, is adapted to control or carry out a method of processing an audio data stream having the above-mentioned features.

The audio processing operation in accordance with embodiments of the invention can be realized by a computer program, that is by software, or by using one or more special electronic optimization circuits, that is in hardware or in a hybrid form, that is by means of software components and hardware components.

In accordance with an embodiment of the invention, an audio-processing and/or audio-reproduction system is provided which is capable of detecting—and, if desired, eliminating—one or more transient portions of an audio input data stream. A harmonics generator may then apply a psycho-acoustic trick (which may include the production of a sequence of harmonics) selectively to such portions of the audio data stream in which no transients occur.

Generating and playing back harmonics in non-transient portions (particularly of a low-frequency regime of audible acoustic content) may give a human listener the subjective impression of the presence of a particular audio frequency contribution, even in a scenario in which this fundamental frequency is not physically present in the audio data stream or cannot be reproduced by the reproduction apparatus (for instance, because the apparatus is too small for playing back bass sounds or because it does not provide such a functionality). Such a psycho-acoustic phenomenon may be denoted as missing fundamental principle.

However, it has been recognized that such a generation of a sequence of harmonics may even deteriorate a human listener's audio quality perception of transient portions of an audio stream. Such transient portions may be portions in the audio stream which are brief in time and/or narrow in frequency distribution, like a percussion beat. For such transient portions, it may thus be advantageous to prevent the generation of a sequence of harmonics and to reproduce such a portion as it is, or to replace it by a non-disturbing audio portion, or to delete such a portion from the stream. Thus, a bass regime may be excepted from the application of a psycho-acoustic trick.

The term "transient portion" may particularly denote an audio stream contribution that is only temporary, i.e. time-limited. A transient may also denote a portion having essentially one frequency or being limited to a very narrow frequency band. Thus, a temporarily narrow portion, which is essentially free of a tonal contribution, may be such a transient. A transient portion may be shorter than 0.5 s, more particularly shorter than 0.1 s in time. Additionally or alternatively, such a transient portion may be narrower than 5 Hz, more particularly narrower than 1 Hz in frequency. The term "transient" may be denoted as the opposite of the term "persistent".

The term "sequence of harmonics" may particularly denote a sequence of frequency peaks which are integral multiples of a fundamental frequency f0, i.e. 2 f0, 3 f0, etc. Such a sequence may be cut off after one, two, three, or even more peaks.

The sound quality as perceived by a human may significantly improve by only selectively applying a psycho-acoustic trick to portions of an audio data stream, which is free of transient portions. Therefore, in an embodiment of the invention, harmonics creation with transient removal may be made possible.

In many cases, small-sized or low-cost audio devices such as GSM devices are incapable of reproducing low audio frequencies ("bass frequencies"). Psycho-acoustic tricks, for instance, based on the missing fundamental principle, can be applied to obtain an improved perception. However, this technique may suffer from artefacts when fed with transient signals. An embodiment of the invention may prevent deteriorations resulting from such an effect by introducing a transient detection and/or transient removal algorithm.

A low-cost device or a small device such as a GSM device may be incapable of reproducing frequencies below a threshold value of, for instance, 1 kHz at a decent level or quality. For instance, a mobile phone may roll off at or below a frequency of around 800 Hz or less. Although a device of this example is still rather good in comparison with other conventional devices, it may not be capable of producing bass sounds, which concentrate in a frequency band between, for instance, 40 Hz and 150 Hz.

In many cases, bass boost algorithms may be inappropriate to solve such a problem. A reason is that boost levels of, for instance, 40 dB may be needed, which may result in heavy audible distortion. Therefore, other methods should be considered in such a situation creating a bass illusion.

A useful principle of creating a bass illusion may be based on what is called the missing fundamental principle. The perceived pitch of a periodic sound is not only based on the fundamental frequency f0 of the sound, but also on its harmonics (which may also be denoted as overtones or partials), which may also be present in the signal. The fundamental frequency is the lowest in frequency of the harmonics, and it usually also has the largest amplitude of all harmonics. However, the perceived pitch of a sound is not simply due to the larger amplitude of the fundamental frequency.

The harmonics may occur as progressive multiples of the fundamental frequency, for instance, 40 Hz, 40 Hz*2=80 Hz, 40 Hz*3=120 Hz, 40 Hz*4=160 Hz, etcetera. If the fundamental frequency is removed from the sound and all other harmonics are kept, then the pitch, which the ear and the brain hear or perceive, is not based on the harmonic with the lowest frequency. A person hears the tone as having the pitch of the original fundamental frequency, even when the fundamental frequency is not physically present in the signal. It is believed that the harmonic structure determines the perception of pitch, rather than the frequency of the lowest harmonic that is physically present in the signal.

This phenomenon may be exploited and/or extended and/or refined by embodiments of the invention. Harmonics can be generated from an original bass signal. In this way, the bass becomes audible on a small device, which small device normally is incapable of reproducing bass sounds.

Embodiments for generating harmonics are harmonics generation by clipping, harmonics generation using mathematical functions, or harmonics generation by means of a full-wave integrator.

However, such an algorithm structure may create unwanted transient harmonics. Transient harmonics may occur particularly when audio content of percussive instruments such as bass or snare drums are processed through a harmonics creator. As these instruments are tuned at one fixed frequency or in a very narrow frequency band and do not usually contain tonal information, they should stay unprocessed instead of being processed with a harmonics generator or the like. Therefore, an embodiment of the invention includes a special system for controlling the input of the harmonics generator in such a way that transients are removed and only tonal residue is fed into the harmonics generator. This may result in a clean and undistorted sound.

To achieve this, a transient removal block may be inserted into a signal path between a filter for extracting low frequencies and a harmonics generator.

Fields of application of embodiments of the invention are, for example, portable devices such as GSM devices, MP3 players, headphones, portable DVDs, gaming devices, laptops, etc.

A periodic sound has a fundamental frequency. A sound is set to have a missing fundamental or suppressed fundamental when its overtones suggest a fundamental frequency but the sound lacks a component at the fundamental frequency itself. For example, when a piano note has a pitch of 100 Hz, it may comprise frequency components, all of which are integral multiples of that value (for instance, 100 Hz, 200 Hz, 300 Hz, 400 Hz, 500 Hz . . . ). However, low-quality stereo speakers may be incapable of reproducing low frequencies, and, consequently, the 100 Hz component may be missing in the acoustic waves emitted by the stereo player. Nevertheless, a pitch corresponding to the fundamental may still be heard. This effect may be denoted as the missing fundamental principle. This principle may be used to create a bass illusion, however, preferably in the absence of transient portions.

In accordance with an embodiment, a harmonics creator with transient removal is provided. Such an embodiment deals with reproduction of bass/pitch (an acoustic frequency range of essentially less than 1 kHz) particularly using a small loudspeaker. Such a harmonics generator may be adapted to generate harmonics of the input signal. A control function may be implemented in such a system, which control function controls the harmonics generator in such a way that transient harmonics are suppressed in the generated harmonic signal. The embodiment may further comprise a selection unit for selecting a desired frequency band from an input signal by a first filter. Furthermore, an envelope extraction unit may be provided and may be followed by low-pass and high-pass filtering branches to arrive at a first signal and a second signal. Moreover, a Boolean logic element may be provided for evaluating the first signal and the second signal, followed by a low-pass filter for modifying the audio data.

In a further embodiment, a device is provided, which comprises an input stage adapted to receive an audio input signal and a harmonics generator adapted to generate harmonic signals of the audio input signal, and a control unit adapted to control the harmonics generator in such a way that transient harmonics are avoided in the generated harmonic signal.

In an embodiment, the control unit comprises a first filter adapted to select a frequency range of the input audio signal yielding a first filtered signal, an envelope extraction unit adapted to determine the envelope of the first filtered signal yielding an envelope signal, a second filter adapted to low-pass filter the envelope signal yielding a first determining signal, a third filter adapted to high-pass filter the envelope signal yielding a second determining signal, a Boolean logic unit adapted to generate a transition signal dependent on comparing said first determining signal with said second determining signal, a fourth filter adapted to filter the transition signal yielding a second filtered signal, and a modifying unit adapted to modify the input audio signal based on the second filtered signal.

Controlling the input of the harmonics generator in such a way that transients are removed and only tonal residue is fed into the harmonics generator may result in an improved sound.

In accordance with a further aspect of the invention, a combination of harmonics generation and transient detection for improving sound quality is provided. Such a transient may be a portion that is not tonal and should not be transposed to higher frequencies (where they might become tonal). Therefore, it may be advantageous to avoid generating harmonics of transient signals.

Further embodiments of the device for processing an audio stream will now be described. However, these embodiments also apply to the method of processing an audio data stream, the program element and the computer-readable medium.

The transient detection unit may be adapted to detect a transient portion as a portion of the audio input data stream being limited in time and/or in frequency by less than a predetermined value. For instance, the transient portion may be a portion being limited in time by less than 0.1 seconds, and its frequency width may be less than 1 Hz.

The device may comprise a (for example, low-pass) filter being adapted to selectively provide the transient detection unit and/or the harmonics generator with contributions of the audio input data stream having a frequency which is lower than a predetermined value. Therefore, only a bass regime may be made the subject of generating harmonics, and other audio contributions may be removed by filtering. In the removed frequency domain, small-sized or low-quality audio devices may not be capable of reproducing such frequencies with sufficient loudness and/or quality. Therefore, applying a psycho-acoustic trick selectively to portions of an audio data stream that differ from transient portions may improve the audio quality. A range of frequencies which is capable of being passed by the filter may be below 200 Hz, particularly a range between 40 Hz and 200 Hz.

The harmonics generator may be adapted to generate the audio output data stream based on a psycho-acoustic trick, which may be particularly a trick of making a human user perceive audio signals without the actual physical presence of such audio signals. An example of such a psycho-acoustic trick is the missing fundamental principle.

The harmonics generator may be adapted to generate the sequence of harmonics by means of at least one of the group consisting of clipping, applying a mathematical function, and full-wave integration. However, many alternative methods of generating harmonics, i.e. multiple integral values of a fundamental frequency, are known to the person skilled in the art and may be applied as well in the context of the invention.

The transient detection unit may be adapted to detect a transient portion as a portion of the audio input data stream originating from a percussive instrument, particularly from a bass or snare drum. The characteristics of such percussive instruments may be stored in the device, and such characteristics may be used for recognizing transient portions, for instance, by means of pattern recognition methods.

The device may further comprise a bandpass filter adapted to selectively remove portions of the sequence of harmonics outside a predetermined frequency band. The application of the psycho-acoustic trick can therefore be reduced to a predetermined frequency interval of, for instance, five times the fundamental frequency.

The transient detection unit may comprise a filter adapted to select a frequency of the audio input data stream that is made the subject of detecting transient portions. Such a filter may have a transmission range that may be less broad than the transmission range of the above-described filter. Since bass and snare drums may mainly cause the transient problem in many cases, which instruments usually operate in a frequency range between 50 Hz and 130 Hz, this filter may also have a transmission range between 50 Hz and 130 Hz. The transient detection and removal works better, the better the transient problem is isolated by the filter.

The transient detection unit may comprise an envelope extraction unit adapted to extract an envelope of the audio input data stream. Such an envelope may be a better basis for performing the transient detection and/or elimination.

The transient detection unit may comprise a low-pass filter and a high-pass filter, wherein a transient portion is detected when the audio input data stream having passed the low-pass filter crosses the audio input data stream having passed the high-pass filter. In other words, the cut-off frequencies of the low-pass filter and the high-pass filter may be adjusted so as to perform an improved or optimized transient detection.

The transient detection unit may comprise a logic unit (for instance, a Boolean logic unit) adapted to compare signals provided at outputs of the low-pass filter and the high-pass filter. Such a logic unit may be, for instance, a comparator or any other logic gate implementing an appropriate Boolean logic function.

The transient detection unit may comprise a smoothing filter adapted to smooth a signal provided at an output of the logic unit. Such a filter may be a low-pass filter as well.

The device may comprise a substitution unit adapted to substitute a detected (and/or removed) transient portion by audio data substitution content. When a transient portion is detected, it is possible that this transient portion is not made the subject of applying the psycho-acoustic trick. Therefore, in order to avoid generation of multiple harmonics of such a transient portion, a predetermined audio filling gap may be interposed at such a position. Such an audio data substitution content may be a synthesis sound or a portion of the audio input data stream.

The transient detection unit may be adapted to remove a detected transient portion from the audio input data stream. In other words, when the transient detection unit has detected a transient, this transient may be deleted from the processed data stream so that no harmonics are generated for this transient. The audio output data stream may therefore be free of transient portions and disturbing harmonics generated for such transient portions. The deleted transient portions may be replaced by audio content pieces so as to further improve the quality of the perceived sound.

The device may comprise an audio playback unit adapted to play back the audio output data stream. Such an audio playback unit may comprise any type of loudspeaker, earpiece, headset, etc. However, the system of the invention may be applied particularly advantageously to an audio playback unit which is incapable of reproducing audio content having frequencies below a threshold value. In this case, the harmonics generation may apply a psycho-acoustic trick so that, even in the absence of the ability of the audio playback unit to play back low frequency values, the human ear may "hear" or perceive such a sound in the presence of a sequence of harmonics. Low-cost loudspeakers or small-sized devices such as GSM devices may be incapable of playing back audio data in a low frequency regime.

The audio playback unit may comprise at least one of the group consisting of a loudspeaker, an earpiece and a headset. The communication between the audio-processing device and such a reproduction unit may be wireless or wired.

Similarly, the communication between an audio data source (for instance, a hard disk on which audio content is stored, or a remote mobile phone communicating with the audio playback device) and the audio playback/audio data-processing device may be carried out in a wired manner (for instance, using a bus or a wired connection) or in a wireless manner (for instance, via a WLAN or a mobile network).

The audio playback device may be realized as a GSM device, headphones, a gaming device, a laptop, a portable audio player, a DVD player, a CD player, a harddisk-based media player, an Internet radio device, a public entertainment device, an MP3 player, a vehicle entertainment device, a car entertainment device, a portable video player, a mobile phone, a medical communication system, a body-worn device, and a hearing aid device. A "car entertainment device" may be a hi-fi system for an automobile.

Although the system according to the invention primarily intends to improve the playback of sound or audio data, it is also possible to apply it for a combination of audio data and visual data. For instance, an embodiment of the invention may be implemented in audiovisual applications such as a video player in which a loudspeaker is used, or a home cinema system.

These and other aspects of the invention are apparent from and will be elucidated with reference to the embodiments described hereinafter.

DESCRIPTION OF EMBODIMENTS

Figure 1:
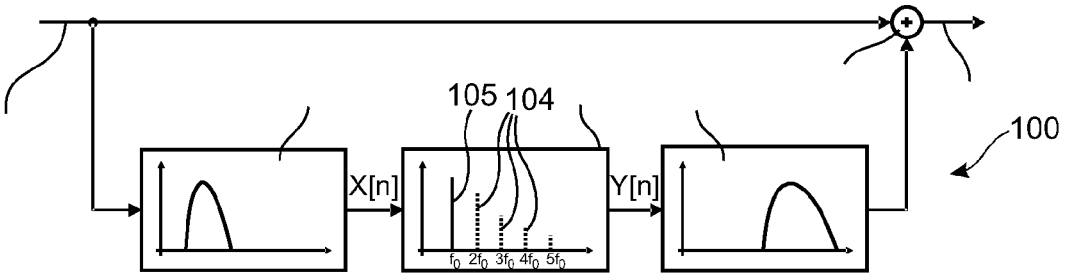
FIG. 1 shows an audio data-processing system.

The illustrations in the drawings are schematic. In different drawings, similar or identical elements are denoted by the same reference numerals or signs.

An audio data-processing system 100 will now be described with reference to FIG. 1.

The audio data-processing system 100 comprises a low-pass filter 101 for selectively supplying a harmonics generator 102 with contributions of an audio input data stream 103 having a frequency that is lower than a predetermined value. In the embodiment of FIG. 1, the low-pass filter 101 has a cut-off frequency of 200 Hz. Thus, the low-pass filter 101 is a filter for extracting the low-frequency portion from an audio input signal 103 and for outputting a filtered signal X[n].

The filtered signal X[n] is supplied to the harmonics generator 102 which is adapted to generate an audio data stream Y[n] based on the stream X[n] and comprises a sequence of harmonics 104 of a fundamental frequency f) 105. In the described embodiment, these harmonics have frequencies of 2 f0, 3 f0, 4 f0, and 5 f0.

The output Y[n] of the harmonics generator 102 is supplied to a filter 106 for limiting the harmonic frequencies 104. The output of the filter 106 is supplied to an adding unit 107, which adds the output of the filter 106 to the audio input data stream 103 so as to generate an audio output data stream 108.

Figure 2:
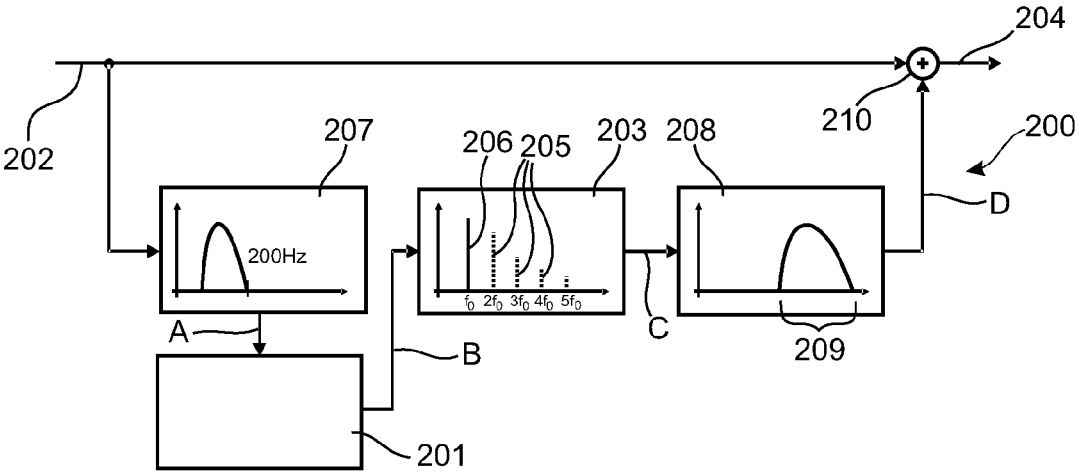
FIG. 2 shows an embodiment of an audio data-processing device according to the invention.

An embodiment of an audio data-processing device according to the invention will now be described with reference to FIG. 2.

The audio data-processing device 200 comprises a transient detection unit 201 for detecting a transient portion of an audio input data stream 202. Furthermore, the audio data-processing device 200 comprises a harmonics generator 203 adapted to generate an audio output data stream 204 based on the audio input data stream 202, wherein the audio output data stream 204 comprises a sequence of harmonics 205, i.e. a sequence of (essentially single) frequency contributions 205 being multiple integers of a fundamental frequency 206 f0. In the embodiment of FIG. 2, the sequence of harmonics 205 comprises the frequencies of 2 f0, 3 f0, 4 f0 and 5 f0. However, since the transients detected by the transient detection unit 201 have been removed by this unit 201, the audio output data stream 204 comprises a sequence of harmonics generated only for frequency portions differing from the transient portions of the audio input data stream 202. This means that harmonics 205 will only be generated for the non-transient portions.

Furthermore, the audio data-processing device 200 comprises a low-pass filter 207 adapted to selectively provide the transient detection unit 201 and the harmonics generator 203 with contributions of the audio input data stream 202, which contributions have a frequency which is lower than a predetermined value of, for instance, 200 Hz. Thus, the low-pass filter 207 is a filter for extracting low frequencies.

The parameters of the transient detection unit 201 may be adjusted so as to detect a transient portion as a portion of the audio input data stream 202 originating from a percussive instrument like a bass or snare drum.

The audio data-processing device 200 further comprises a bandpass filter 208 adapted to selectively remove portions of the sequence of harmonics 205 which are located outside a predetermined frequency band 209.

Furthermore, an adding unit 210 is provided for adding the output signal of the bandpass filter 208 to the audio input data stream 202 so as to generate the audio output data stream 204.

The signal supplied from the low-pass filter 207 to the transition detection unit 201 is denoted by reference sign "A", the signal supplied from the transient detection unit 201 to the harmonics generation unit 203 is denoted by reference sign "B", the signal output from the harmonics generator 203 and supplied to the bandpass filter 208 is denoted by reference sign "C", and the signal provided at the output of the bandpass filter 208 and supplied to the adding unit 210 is denoted by reference sign "D".

The constitution of the transient detection unit 201 will now be described in more detail with reference to FIG. 3.

The signal A is supplied to a filter 300 adapted to select a frequency band of the audio input data stream 202, which frequency band defines the frequencies for which the detection of transient portions is performed. Thus, the filter 300 selects the frequency range to be controlled.

Furthermore, the filter 300 is coupled with an envelope extraction unit 301 adapted to extract an envelope of the audio input data stream 103. The envelope extraction unit 301 thus determines the envelope of the signal provided at an input of the envelope extraction unit 301.

The output of the envelope extraction unit 301 is provided at an input of a low-pass filter 302 and a high-pass filter 303.

A transient portion may be detected when the audio input data stream 103 having passed the low-pass filter 302 crosses the audio input data stream 202 having passed the high-pass filter 303. In other words, when the high-pass signal crosses the low-pass signal, it is assumed that a transient has occurred.

The output of the low-pass filter 302 is supplied to a first scaling unit 304, and the output of the high-pass filter 303 is supplied to a second scaling unit 305.

The outputs of the scaling units 304, 305 are supplied to a Boolean logic unit 306. When the high-pass signal is larger than the low-pass signal, it is assumed that a transient has occurred and the Boolean logic unit 306 makes a transition from a logic value "1" to a logic value "0". The logic unit 306 is thus adapted to compare signals provided at outputs of the low-pass filter 302 and the high-pass filter 303.

Furthermore, the transient detection unit 201 comprises a smoothing filter 307 adapted to smooth a signal provided at an output of the logic unit 306. The low-pass filter 307 smoothes out the amplitude scaling applied to the signal that will be fed to the harmonics generator 203.

Figure 3:
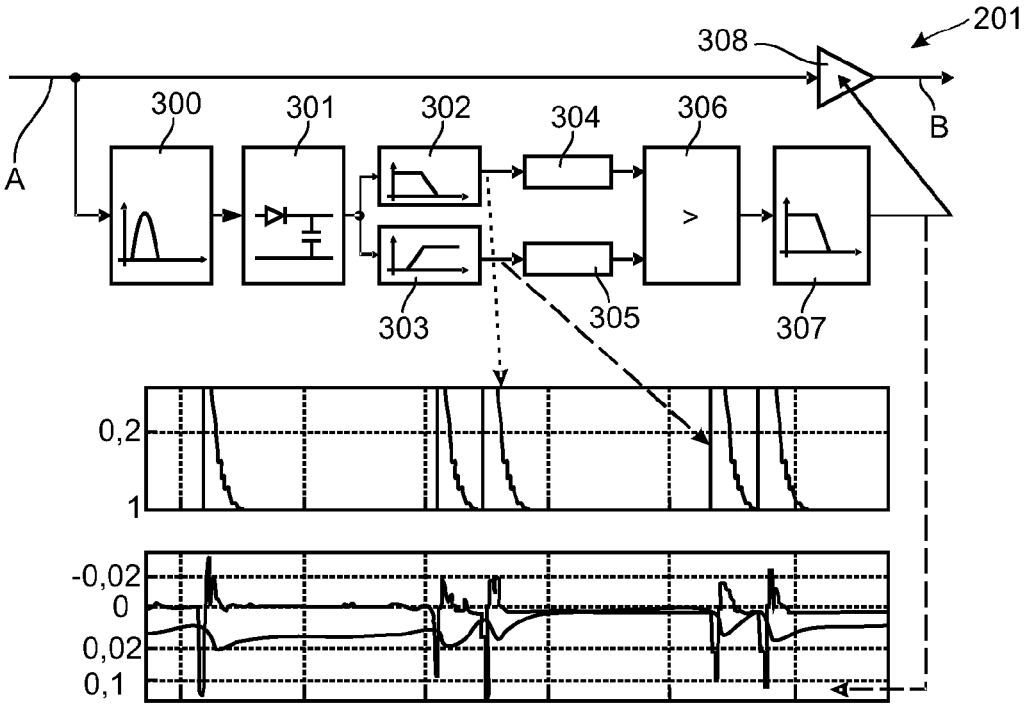
FIG. 3 shows a part of an audio data-processing system according to the invention.

As can be seen from FIG. 3, the output of the smoothing filter 307 is used for controlling the modification of signal A to the signal B by means of a unit 308.

Since transients are usually very short (in time) and because of the smooth "fade in" due to the control signal filtering, the envelope shaping is not disturbing.

An alternative embodiment of the transient detection unit 201 will now be described with reference to FIG. 4.

Figure 4:
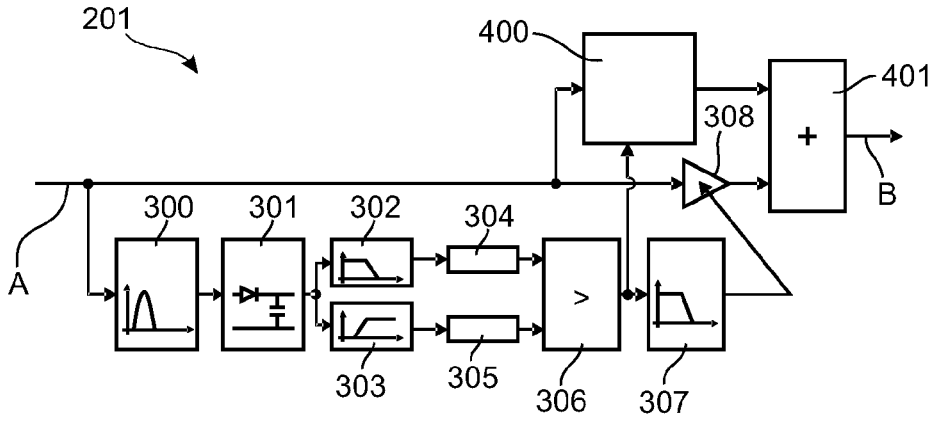
FIG. 4 shows a part of an audio data-processing system according to the invention.

The transient detection unit of FIG. 4 differs from the transient detection unit of FIG. 3 in that a substitution unit 400 is provided in FIG. 4. The substitution unit 400 is adapted to substitute a detected transient portion by audio data substitution content, such as a synthesis sound or a portion of the audio input data stream 202. In other words, the embodiment of FIG. 4 involves filling the gap created by the transition removal with a synthesis sound (from a fundamental detection) or a sample taken from the original sound. The substitution unit 400 thus triggers a sample or a synthesized sound insertion in the audio stream. This contribution is summed by a summing unit 401 in the manner as shown in FIG. 4.

Figure 5:
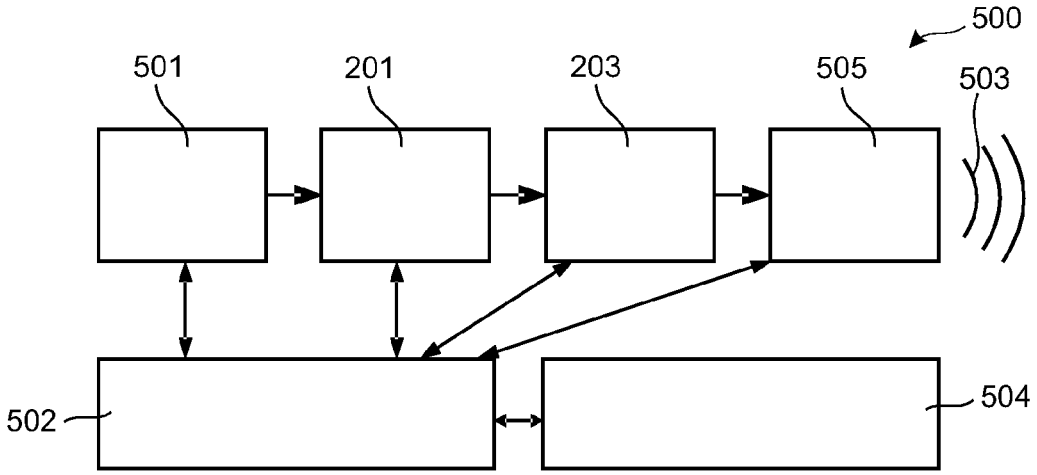
FIG. 5 shows an embodiment of an audio data-processing system according to the invention.

An embodiment of an audio data-processing system 500 according to the invention will now be described with reference to FIG. 5.

The audio data-processing system 500 is adapted as a hard-disk-based MP3 player.

Audio content, such as a plurality of songs, is stored on a hard disk 501. Under the control of a control unit 502, for instance, a central processing unit (CPU), audio data content stored on the hard disk 501 may be transferred to a transient detection unit 201 for detecting and removing transient portions from the audio data stream. The output of the transient detection unit 201 is supplied to a harmonics generator 203 for providing harmonics for non-transient bass portions.

The output of the harmonics generator 203 may be supplied to an audio reproduction unit, such as a loudspeaker 505, so as to reproduce the audio content to generate acoustic waves 503. Furthermore, a user input/output device 504 is provided as a user interface by means of which a human user may control the functionality of the system 500, for instance, by providing the CPU 502 with control signals.

Figure 6:
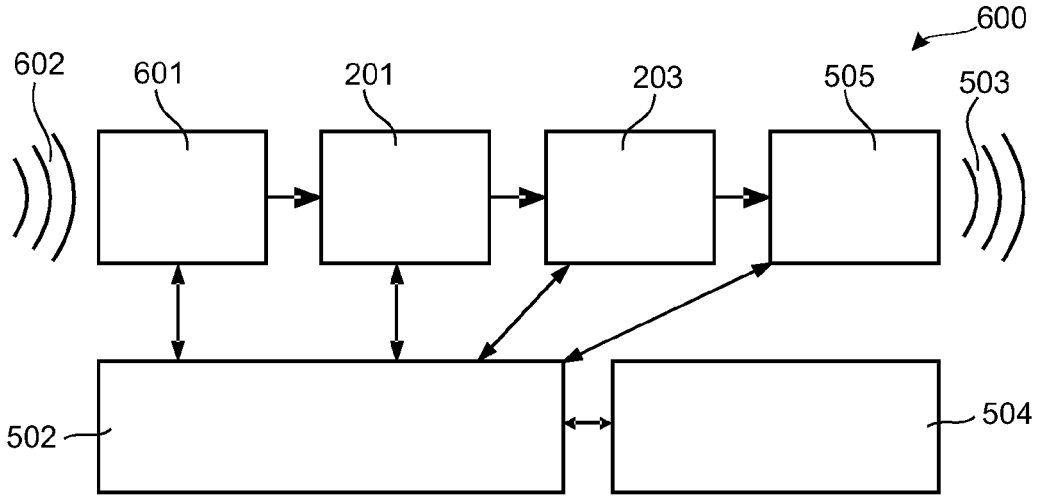
FIG. 6 shows a further embodiment of an audio data-processing system according to the invention.

An embodiment of an audio data-processing system 600 will now be described with reference to FIG. 6.

The audio data-processing system 600 is a mobile phone having an antenna 601 by means of which electromagnetic waves 602 may be captured. These electromagnetic waves 602 may include human speech or music or other environmental noise. Again, the captured signal 602 may be converted into audio data and supplied to the transient detection unit 201, from which it is supplied to the harmonics generator 203 so as to generate reproducible audio signals in a reproduction unit 505, for instance, an earpiece.

The earpiece 505 may thus emit acoustic waves 503. Again, the function of the system 600 is under the control of the CPU 502 and/or of the user input/output device 504.

It should be noted that use of the verb "comprise" and its conjugations does not exclude other elements or steps and use of the indefinite article "a" or "an" does not exclude a plurality of such elements or steps. Also elements described in association with different embodiments may be combined.

It should also be noted that reference signs in the claims shall not be construed as limiting the scope of the claims.

The invention claimed is:

1. A device for processing an audio data stream having transient portions and non-transient portions, the device comprising:

a transient detection unit configured and arranged to detect the transient portions of the audio input data stream and filter transient portions of the audio input data stream from inclusion in an audio output data stream, wherein the transient detection unit includes a low-pass filter and a high-pass filter, wherein the transient detection unit further includes a logic unit adapted to compare signals provided at an output of the low-pass filter and at an output of the high-pass filter; and wherein the transient detection unit is adapted to detect a transient portion of the audio data stream when the audio input data stream having passed the low-pass filter crosses the high-pass filter and a smoothing filter adapted to smooth the audio input data stream; and a harmonics generator configured and arranged to generate the audio output data stream based on the audio input data stream as filtered by the transient detection unit, the audio output data stream including a sequence of harmonics generated from the non-transient portions of the audio input data stream without contribution of the transient portions of the audio input data stream.

2. The device according to claim 1, wherein the transient detection unit is further configured and arranged to detect a transient portion as a portion of the audio input data stream being limited in time by less than a predetermined time value and/or being limited in frequency by less than a predetermined frequency value, and further including a substitution unit configured and arranged to substitute a detected transient portion with audio data substitution content.

3. The device according to claim 1, further including a filter adapted to selectively provide the transient detection unit or the harmonics generator with contributions of the audio input data stream having a frequency which is lower than a predetermined value or which is within a predetermined interval, and the transient detection unit is further configured and arranged to remove a detected transient portion from the audio input data stream.

4. The device according to claim 1, wherein the harmonics generator is configured and arranged to generate the audio output data stream based on a psycho-acoustic manipulation of the audio input data stream, and the transient detection unit is further configured and arranged to replace a detected transient portion from the audio input data stream with audio data substitution content.

5. The device according to claim 1, wherein the harmonics generator is further configured and arranged to generate the audio output data stream based on a missing fundamental principle scheme applied to the audio input data stream, and the transient detection unit is further configured and arranged to remove a detected transient portion from the audio input data stream and wherein the transient detection unit further includes a substitution unit configured and arranged to substitute a detected transient portion with audio data substitution content that includes a synthesis sound.

6. The device according to claim 1, wherein the harmonics generator is further configured and arranged to generate the sequence of harmonics by means of at least one of the group consisting of clipping, applying a mathematical function, and full-wave integration, and the transient detection unit is further configured and arranged to remove a detected transient portion from the audio input data stream, and wherein the transient detection unit further includes a substitution unit configured and arranged to substitute a detected transient portion with audio data substitution content that includes a sample taken from the audio input stream.

7. The device according to claim 1, wherein the transient detection unit is further configured and arranged to detect a transient portion as a portion of the audio input data stream originating from a percussive instrument, particularly originating from a bass or snare drum.

8. The device according to claim 1, further including a bandpass filter configured and arranged to selectively remove portions of the sequence of harmonics outside a predetermined frequency band.

9. The device according to claim 1, wherein the transient detection unit further includes a filter adapted to select a frequency or a frequency band of the audio input data stream which is made the subject of detecting transient portions.

10. The device according to claim 1, wherein the transient detection unit further includes an envelope extraction unit adapted to extract an envelope of the audio input data stream.

11. The device according to claim 1, further including a substitution unit configured and arranged to substitute a detected transient portion by audio data substitution content.

12. The device according to claim 11, wherein the audio data substitution content is a synthesis sound or a portion of the audio input data stream.

13. The device according to claim 11, wherein the transient detection unit is further configured and arranged to remove a detected transient portion from the audio input data stream.

14. The device according to claim 1, further including an audio playback unit configured and arranged to play back the audio output data stream.

15. The device according to claim 14, wherein the audio playback unit is incapable of playing back audio data having frequencies below a threshold value.

16. The device according to claim 14, wherein the audio playback unit further includes at least one of the group consisting of a loudspeaker, an earpiece and a headset.

17. The device according to claim 1, realized as at least one of the group consisting of a GSM device, headphones, a gaming device, a laptop, a portable audio player, a DVD player, a CD player, a harddisk-based media player, an Internet radio device, a public entertainment device, an MP3 player, a hi-fi system, a vehicle entertainment device, a car entertainment device, a portable video player, a mobile phone, a medical communication system, a body-worn device, and a hearing aid device.

18. A method of processing an audio data stream having transient portions and non-transient portions, the method comprising the steps of:

detecting the transient portions of an audio input data stream, wherein the transient portions are detected by a transient detection unit that includes a low pass filter and a high pass filter; wherein the transient detection unit further includes a logic unit adapted to compare signals provided at an output of the low-pass filter and at an output of the high-pass filter; and the detecting is performed when the audio data stream having passed the low-pass filter crosses the high-pass filter;

in response to the step of detecting, filtering the transient portions of the audio input data stream from inclusion in generation an output data stream and smoothing the audio input data stream using a smoothing filter; and generating an audio output data stream based on the audio input data stream as filtered, the audio output data stream includes a sequence of harmonics generated from the non-transient portions of the audio input data stream without contribution of the transient portions of the audio input data stream.

19. A non-transitory computer-readable medium, in which a computer program is stored which, when being executed by a processor, is adapted to control or carry out a method of processing an audio data stream having transient portions and non-transient portions, the method comprising:

using the processor to execute the computer program stored on the non-transitory computer-readable medium that causes the processor to carry out the steps of detecting the transient portions of an audio input data stream, wherein the transient portions are detected by a transient detection unit that includes a low pass filter and a high pass filter wherein the transient detection unit further includes a logic unit adapted to compare signals provided at an output of the low-pass filter and at an output of the high-pass filter; and the detecting is performed when the audio data stream having passed the low-pass filter crosses the high-pass filter;

in response to the step of detecting, filtering the transient portions of the audio input data stream from inclusion in generation of an output data stream and smoothing the audio input data stream using a smoothing filter; and generating an audio output data stream based on the audio input data stream as filtered, the audio output data stream including a sequence of harmonics generated from the non-transient portions of the audio input data stream without contribution of the transient portions of the audio input data stream.

* * * * *